United States Patent [19]

Harvey

[11] 4,384,457

[45] May 24, 1983

[54] HOT GAS ENGINE CONVERTOR

[76] Inventor: Roger O. Harvey, 657 Geneva Pl., Tampa, Fla. 33606

[21] Appl. No.: 202,377

[22] Filed: Oct. 30, 1980

[51] Int. Cl.[3] ..... F02G 1/06

[52] U.S. Cl. ..... 60/524; 60/659; 60/665

[58] Field of Search ..... 60/517, 524, 659, 515, 60/669, 665, 650, 682

[56] References Cited

U.S. PATENT DOCUMENTS

| | | | |
|---|---|---|---|
| 3,956,892 | 5/1976 | Nystrom | 60/524 |
| 3,984,980 | 10/1976 | Wise | 60/517 |
| 4,126,995 | 11/1978 | Asselman et al. | 60/524 |

*Primary Examiner*—Allen M. Ostrager
*Assistant Examiner*—Stephen F. Husar
*Attorney, Agent, or Firm*—Duckworth, Allen, Dyer & Pettis

[57] ABSTRACT

A convertor for a hot gas engine whereby such an engine may be more economically operated. The invention comprises an improvement to a standard hot gas engine including at least one combustion chamber and conduits for supplying a mixture of fuel and air to the combustion chamber comprising a heat sink disposed above the piston head, a fuel iris operatively mounted above the heat sink and a fuel flow controller connected to the heat sink and to the fuel iris for regulating the flow of fuel to the engine in response to the temperature of the heat sink. The improvement of this invention permits operation of the invention on residual heat, thereby permitting increased fuel economy. The invention further contemplates using the engine to power an alternator whereby electrical energy may be derived, stored and used for work.

16 Claims, 6 Drawing Figures

FIG. 1
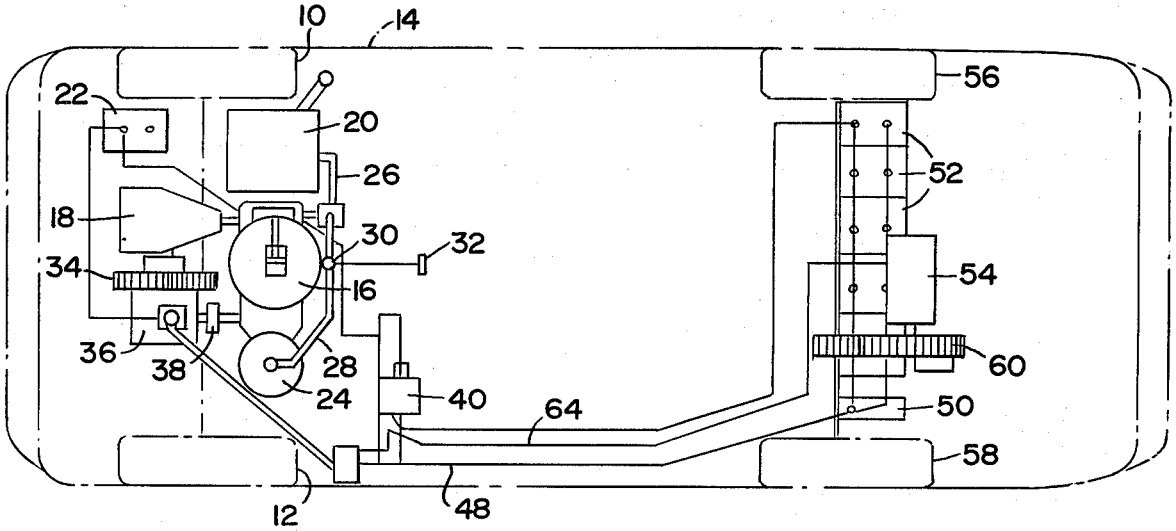
FIG. 2
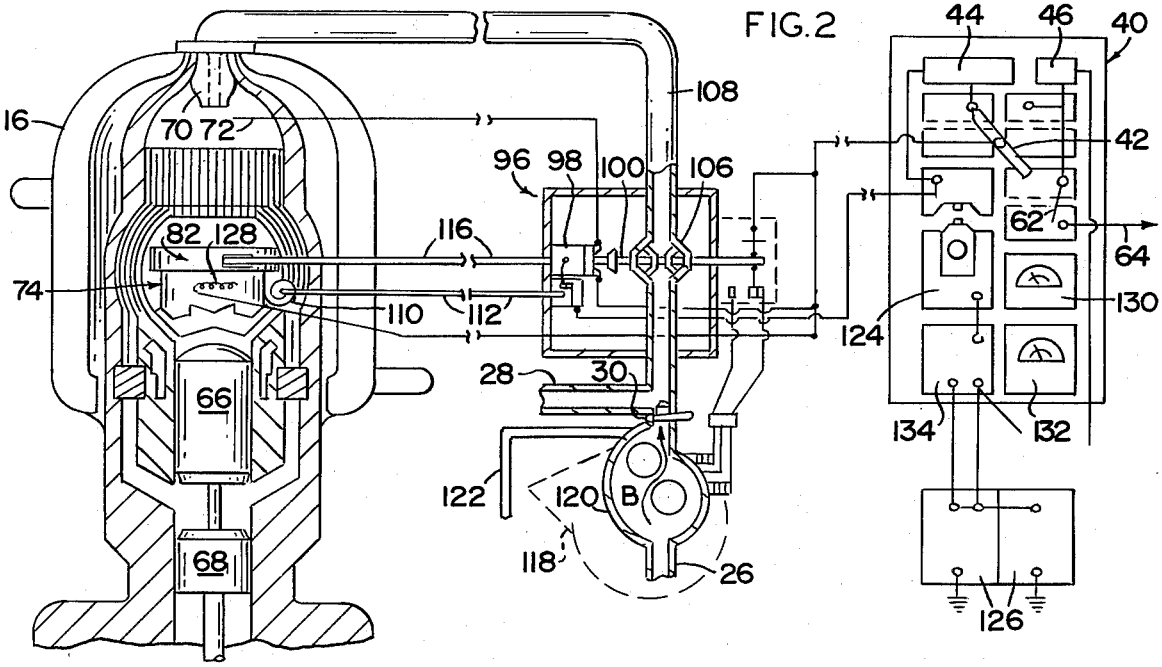
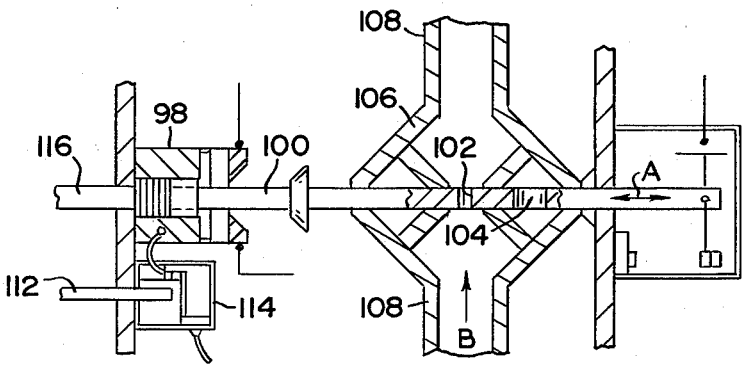
FIG. 4

HOT GAS ENGINE CONVERTOR

BACKGROUND OF THE INVENTION

1. Field of the Invention

This invention relates to an improvement in hot gas engines including at least one combustion chamber and means for supplying a mixture of fuel and air to the combustion chamber wherein the improvement comprises the placement of a heat sink above the piston head for retaining excess heat of combustion. A fuel iris means is operatively mounted above the heat sink means and fuel flow controlling means are operatively connected to the heat sink means and the fuel iris means whereby the flow of fuel to the engine may be regulated in response to the temperature of the heat sink. In accord with the disclosure of this invention, the hot gas engine may be utilized to provide direct work energy, and may also be utilized to power an alternator whereby power from the hot gas engine may drive an alternator to generate electrical energy.

2. Description of the Prior Art

Hot gas engines such as, for example, the Stirling rhomboid hot gas engine and a flash boiler-turbine, are quite well known and old in the prior art. Moreover, the function and operation of a Stirling cycle engine has long been known and understood, and many prior art patents and other publications disclose means for operating such engines during periods of intermittent fuel supply. Basically, such prior art teachings involve means for storing heat of combustion so that the engine may continue to operate on that residual heat even when the primary fuel source is interupted.

One such teaching is contained in U.S. Pat. No. 3,029,596 to Hanold. That patent teaches a heat storage arrangement used in combination with a Stirling cycle engine whereby the engine will continue to operate during periods when the source of heat (the sun's rays in this instance) is removed. U.S. Pat. No. 3,045,625 to Schroder teaches the use of a heat accumulator comprising a eutetic mixture of lithium fluoride and sodium fluoride and/or magnesium fluoride and/or potassium fluoride and/or calcium fluoride for supplying thermal energy to a hot gas engine. Nystrom, in his U.S. Pat. No. 3,956,892, teaches a fuel-air regulating system for such hot gas engines which is temperature controlled for supplying fuel and air to the engine dependent upon the temperature of the working gas. A similar teaching involving temperature-controlled fuel supply to the burner of a hot gas engine is provided in U.S. Pat. No. 3,782,120 to Brandenburg. Other modifications of, and uses for hot gas engines are disclosed in the following U.S. patents:

U.S. Pat. No. 2,588,530 to Ifield, issued Mar. 11, 1952
U.S. Pat. No. 4,070,860 to Hanson, issued Jan. 31, 1978
U.S. Pat. No. 4,100,741 to Michels, issued July 18, 1978

Thus, the use of Stirling cycle engines as well as other similar hot gas engines for deriving a work force is well known. It is furthermore known that residual heat within the combustion chamber may be utilized to operate the engine even when the heat source is interupted. However, if the excess heat of combustion could be more efficiently contained within the engine's cylinder containing the displacer piston, and if fuel supply could be regulated and coordinated with the temperature of the combustion chamber, significantly increased fuel efficiency could be obtained.

SUMMARY OF THE INVENTION

The present invention relates to an improvement in hot gas engines including at least one combustion chamber and means for supplying a mixture of fuel and air to the combustion chamber wherein the improvement comprises heat sink means disposed above the piston head for retaining heat and improving the fuel efficiency of the engine. In order to further enhance the heat-retaining characteristics of the heat sink means, a fuel iris means is operatively mounted above the heat sink means and a fuel flow controlling means is connected to the heat sink means and the fuel iris means whereby the flow and air to the engine may be regulated in response to the temperature of the heat sink.

While the heat sink means may be formed of any suitable material capable of withstanding the internal temperatures of the hot gas engine, it has been determined that aluminum oxide placed within cast iron sleeves has entirely satisfactory heat-retaining characteristics. The fuel iris means disposed just above the heat sink actually serves a dual purpose. When the fuel iris means is opened, it readily permits the passage of heat from burning fuel and air through the heat sink onto the piston head for operating the engine. As will be discussed in greater detail below, when the temperature of the heat sink means reaches a predetermined level, the fuel iris means will close as the fuel supply is secured, thereby more efficiently retaining heat within the combustion chamber adjacent the piston head. The fuel flow controlling means of this invention comprises a fuel metering valve including a first fuel orifice and a second fuel orifice. The metering valve is movable to protect the flow of fuel through either the first or the second orifice in response to temperatures sensed within the heat sink means. In order to accomplish movement within the first and second fuel orifices, the fuel flow controlling means further comprises a temperature sensing means mounted on the heat sink. The temperature sensing means is electromechanically connected to the fuel metering valve to selectively position the valve at either the first or the second fuel orifice. In the preferred embodiment, the first fuel orifice is defined by an aperture of relatively small diameter, whereby only enough fuel/air mixture is admitted into the combustion chamber to provide what might be termed "pilot light" operation. When the first orifice is in operative position, the fuel iris means is closed, and the engine is actually operating off residual heat from the heat sink means. Then, when the temperature falls to a predetermined level, the metering valve shifts to the second fuel orifice permitting a fuel flow of fuel/air into the combustion chamber. Simultaneously, the fuel iris means is opened to permit the heat of combustion to pass therethrough onto the piston head.

Operation of the fuel iris means is accomplished by an iris rod. One end of the iris rod is attached to the fuel iris and the other end of the rod is electromechanically attached to the fuel metering valve. Thus, operation of the fuel metering valve in response to the temperature of the sink means will result in corresponding operation of the fuel iris means.

Thus, by virtue of the unique relationships between the heat sink means, the fuel iris means, and the fuel flow controlling means, operation of the hot gas engine may be maintained at efficient levels during periods of significantly reduced fuel consumption.

As will be set forth in greater detail hereinafter with particular regard to a preferred embodiment for this invention, the hot gas engine convertor is of this invention may be used in combination with Stirling cycle engines as well as a flash boiler/turbine. Also disclosed and claimed hereinafter is my application of the hot gas engine convertor to an automobile whereby a Stirling cycle engine may be utilized to provide front wheel drive while at the same time powering an alternator to provide electrical energy which may be stored in batteries and used to power an electric drive motor operatively attached to the rear wheels of a vehicle. It is thus entirely possible to utilize the improved Stirling cycle engine for providing motive force to a vehicle through a front wheel drive arrangement while at the same time storing electrical energy which may be utilized by an electric motor to provide motive power to the vehicle through the rear wheels. Obviously, then, when the batteries are fully charged, and should operating conditions require it, four wheel drive may be provided.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which:

FIG. 1 is a plan view of the application of a preferred embodiment of the invention to an automobile.

FIG. 2 is a sectional view schematically illustrating the hot gas engine convertor and its electrical controls.

FIG. 4 is a detail sectional view of a portion of the fuel flow controlling means.

Similar reference characters refer to similar parts throughout the several views of the drawings.

DETAILED DESCRIPTION

Figure 3:
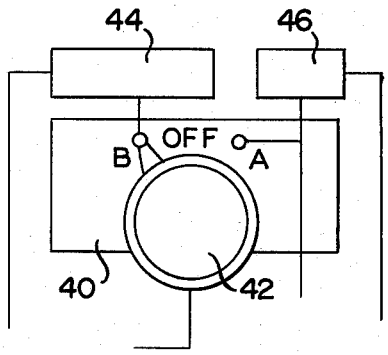
FIG. 3 is a schematic representation of the switch means of the invention.

In the following detailed description the hot gas engine convertor of this invention will be described in a preferred embodiment suitable for use in combination with a Stirling cycle engine operatively mounted within the frame of an automobile. Also disclosed are means for using the Stirling cycle engine not only for driving the automobile through a front wheel drive arrangement, but also for charging a series of storage batteries wherey the automobile may also be driven by an electric motor operatively connected to the automobile's rear wheels. Throughout this detailed description it is to be understood that it is being given with regard to a preferred embodiment for the invention. There is no intention to limit the hot gas engine convertor to the particular environment and installation hereinafter described.

Referring first to the schematic representation of FIG. 1, it can be seen that the front wheels 10 and 12 of automobile 14 may be powered by Stirling rhomboid engine 16 through fluid drive transmission 18. Liquid fuel is provided to Stirling engine 16 from primary fuel tank 20 and is started using electrical energy from actuator battery 22. Primary fuel tank 20 would preferably contain a liquid fuel such as, for example, gasoline, alcohol, or mixtures of gasoline and alcohol. A secondary fuel tank 24 may be provided and would preferably contain a compressed fuel such as, for example, liquified petroleum gas. As shown in the schematic representation of FIG. 1, a primary fuel line 26 is provided from primary fuel tank 20 and a corresponding secondary fuel line 28 is provided from secondary fuel tank 24. Fuel selector valve 30 is operatively disposed at the junction of primary fuel line 26 and secondary fuel line 28, and selector valve 30 is regulated by the automobile operator by manipulation of fuel line selector control 32. It is to be understood that selector control 32 may be manual, electrical, or electronic. Motive power from Stirling engine 16 is transmitted to wheels 10 and 12 through fluid drive transmission 18 and front wheel drive gear train 34.

As indicated above, Stirling engine 16 is of the dual shaft rhomboid gearing type. Therefore, an alternator 36 may also be operatively attached to Stirling engine 16 as by magnetic clutch 38. A control panel 40 is mounted within the vehicle, accesible to the operator, for determining the operating mode of vehicle 14. Attention is invited to the schematic representation of FIG. 3 for an explanation of the operation of control panel 40.

As shown in the view of FIG. 3, control panel 40 includes a selector switch 42 and three operating conditions marked "B," "OFF," and "A." The setting labeled "OFF" corresponds to automobile 14 being secured. In order to start the automobile, selector switch 42 is moved to the "B" position thereby permitting the flow of electricity from actuator battery 22 through battery circuit breaker 44 to Stirling engine 16. Then, once Stirling engine 16 has reached its operating condition, selector switch 42 may be moved to position "A," thereby securing actuator battery 22 and actuating alternator 36 through alternator circuit breaker 46. Electrical power generated by alternator 36 may be delivered by a conduit 48 through charger 50 for storage in electric drive batteries 52. These batteries 52 may then be utilized to provide all necessary electrical power to the automobile 14. Alternatively, electricity from batteries 52 may be utilized to power electric drive motor 54 which is operatively connected to rear wheels 56 and 58 by rear wheel drive gear train 60. The operation of electric drive motor 54 is regulated by rheostat switch 62 mounted within control panel 40 and electrically connected to electric drive motor 54 by rheostat switch conduit 64.

Accordingly, one form of the preferred embodiment of this invention permits operation of automobile 14 as a front wheel drive vehicle by Stirling engine 16, or as a rear wheel drive vehicle by electric drive motor 54. Alternatively, both Stirling engine 16 and electric drive motor 54 may be actuated at the same time to permit four wheel drive operation.

Attention is now invited to the views of FIGS. 2, 4, 5 and 6 for a description of the preferred embodiment of the hot gas engine convertor used in combination with Stirling engine 16.

Figure 5:
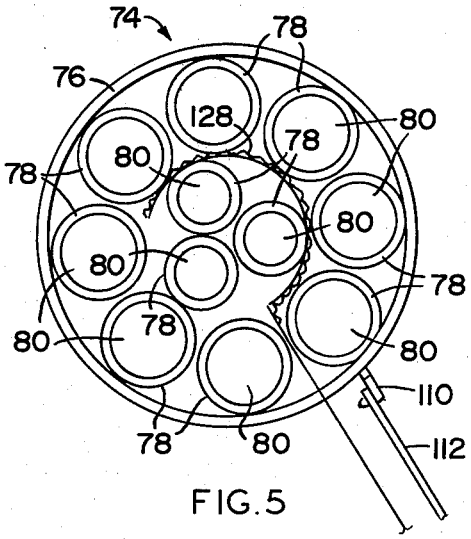
FIG. 5 is a top plan view of the heat sink means.

As best seen in the view of FIG. 2, Stirling engine 16 includes a displacer piston 66 and a work piston 68. The fuel air mixture is introduced into the combustion chamber above the head of piston 66 through fuel tip 70, and combustion is accomplished by means of a glow plug (not shown) operatively connected to ignitor circuit 72. Heat sink means 74 is mounted within the combustion chamber above the head of piston 66. In the view of FIG. 5 it can be seen that heat sink means 74 comprises a metallic ring 76, preferably formed from a copper alloy or iron, and further comprises a plurality of metallic sleeves 78 disposed within ring 76 in spaced apart, substantially transverse relation to the axis of ring 76. Included within each of the rings 78 is a quantity of heat storage material 80. In this preferred embodiment, sleeves 78 are formed from cast iron, and heat storage material 80 comprises aluminum oxide. Thus, while the heat of combustion within the combustion chamber will operate engine 16, excess heat will be retained and stored within heat sink means 74. As will be set forth in greater detail below, this retained heat may then be utilized to further operate Stirling engine 16 without the addition of a normal full fuel flow thereto.

Figure 6:
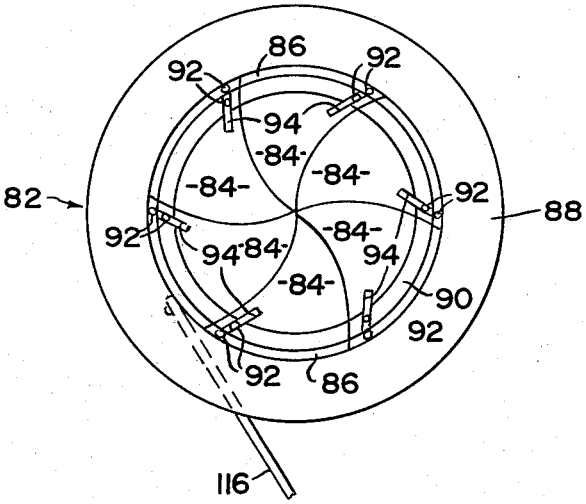
FIG. 6 is a top plan view of the fuel iris means.

Operatively disposed immediately above heat sink means 74 is the fuel iris means 82 of this invention. The detailed view of FIG. 6 depicts a preferred construction for fuel iris means 82. As shown therein, fuel iris means 82 comprises a plurality of iris leaves 84 which are movably attached to iris operating ring 86. The fuel iris means 82 further comprises an outer body 88 on which movable operating ring 86 is mounted and a fixed ring 90 disposed between leaves 84 and operating ring 86. Each of the leaves 84 is movably attached to operating ring 86 by pins 92 which ride in slots 94. Thus, movement of operating ring 86, as will be described hereinafter, will cause leaves 84 to open and close.

Again with reference to the view of FIG. 2, it can be seen that the hot gas engine convertor of this invention further comprises fuel flow controlling means 96, a portion of which is shown in detail in the view of FIG. 4. It can also be seen that fuel flow controlling means 96 is connected to heat sink means 74 and fuel iris means 82.

Fuel flow controlling means 96 comprises a fuel metering valve 98. A fuel metering rod 100 is operatively connected to valve 98 and includes a first fuel orifice 102 and a second fuel orifice 104 formed therethrough. Valve 98 moves metering rod 100 back and forth as indicated by arrow A in the view of FIG. 4, and thereby selectively positions either first fuel orifice 102 or second fuel orifice 104 within throat 106 of fuel conduit 108. Of course, fuel comprising the fuel/air mixture flows through fuel conduit 108 as indicated by arrow B.

The operation of fuel metering valve 98 is controlled by temperature sensing means 110 mounted on ring 76 of the heat sink means 74. As best seen in the views of FIGS. 2 and 5, temperature sensing means 11 is electromechanically connected to fuel metering valve 98 by arm 112. As the temperature sensed by temperature sensing means 110 increases, sensing means 110 will expand moving arm 112 away from heat sink means 74. This will break the circuit at microswitch 114 within fuel metering valve 98 which not only positions first orifice 102 as shown in the view of FIG. 4, but also closes fuel iris means 82.

The closing of fuel iris means 82 is accomplished by the action of iris rod 116, one end of which is attached to iris operating ring 86 and the other end of which is electromechanically attached to fuel metering valve 98. Thus, in the positions illustrated in the views of FIGS. 2, 4 and 6, only a minimum quantity of fuel passes through first orifice 102, through fuel conduit 108, and out fuel tip 70 into the combustion chamber. This permits what may best be termed "pilot light" operation of Stirling engine 16. Motive power is actually being derived from residual heat within heat sink means 74. Furthermore, this residual heat is retained in relatively close proximity to the heat of piston 66 by virtue of the fact that leaves 84 of the fuel iris means 82 are closed. As the residual heat within heat sink means 74 decreases, this will be sensed by temperature sensing means 110 which will contract, pulling arm 112 back into contact with microswitch 114. This results in the disposition of second fuel orifice 104 into throat 106 and a corresponding, substantially simultaneous opening of iris leaves 84. A full flow of fuel may now enter the combustion chamber through fuel conduit 108 and fuel tip 70.

Further with regard to the view of FIG. 2, it can be seen that the fuel supply system of the engine does include a combustion air blower 118 and a primary fuel pump 120 for operating conditions when fuel line selector valve 30 is positioned to allow operation on pressurized fuel through secondary fuel line 28, a fuel bypass return 122 is provided to return primary fuel to its primary fuel tank 20.

It should also be noted that whenever ignition switch 124, mounted within control panel 40 is activated, immediate electrical power will be drawn from batteries 126 to position second fuel orifice 104 within throat 106, to energize combustion air blower 118 and primary fuel pump 120, to open fuel iris means 82, and to energize ignitor circuit 72. Furthermore, in the illustrated embodiment, booster heater 128 disposed within the heat sink means 74 will also be energized until a predetermined operating temperature is achieved within the combustion chamber. Finally, it can be seen that control panel 40 further includes a temperature gauge 130 and a voltmeter 132. A second battery charge 134 is also provided for maintaining the charge on batteries 126 once selector switch 42 is moved to position "A."

As previously stated, while this preferred embodiment has been described with specific regard to a Stirling cycle rhomboid engine operatively installed in an automobile and further including an electric drive motor, the invention is not to be limited thereto.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features herein described, and all statements of the scope of the invention, which, as a matter of language, might be said to fall therebetween.

Now that the invention has been described,

What is claimed is:

1. In a hot gas engine including at least one combustion chamber and means for supplying a mixture of fuel and air to the combustion chamber, the improvement comprising: heat sink means disposed within the combustion chamber for improving the fuel efficiency of the engine; fuel iris means operatively mounted above said heat sink means whereby the transmission of combustion heat to and from said heat sink means may be regulated; and fuel flow controlling means connected to said heat sink means and said fuel iris means whereby the flow of fuel to the engine may be regulated in response to the temperature of said heat sink means.

2. The improved hot gas engine of claim 1 wherein said heat sink means comprises a metallic ring disposed within the combustion chamber, said heat sink means further comprising a plurality of metallic sleeves disposed within said ring in spaced apart, substantially transverse relation to the axis of said ring, each of said plurality of said sleeves including a heat storage material placed therein, whereby heat of combustion may be retained within said heat sink means.

3. The improved hot gas engine of claim 2 wherein said ring is formed from iron.

4. The improved hot gas engine of claim 2 wherein said ring is formed from copper alloy.

5. The improved hot gas engine of claim 4 wherein said plurality of sleeves are formed from cast iron.

6. The improved hot gas engine of claim 5 wherein said heat storage material comprises an inorganic metal compound.

7. The improved hot gas engine of claim 6 wherein said heat storage material comprises aluminum oxide.

8. The improved hot gas engine of claim 2 wherein said fuel iris means comprises a plurality of iris leaves, each of said leaves being movably attached to an iris operating ring, whereby rotation of said iris operating ring will open and close said fuel iris means.

9. The improved hot gas engine of claim 8 wherein said fuel flow controlling means comprises a fuel metering valve including a first fuel orifice and a second fuel orifice, said metering valve being movable to permit the flow of fuel through one of said first and second fuel orifices in response to temperature sensed within said heat sink means.

10. The improved hot gas engine of claim 9 wherein said fuel flow controlling means further comprises temperature sensing means mounted on said heat sink means metallic ring and electromechanically connected to said fuel metering valve to selectively position said valve at said first and said second fuel orifices.

11. The improved hot gas engine of claim 10 wherein said fuel flow controlling means further comprises an iris rod, one end of said rod being attached to said iris operating ring and the other end of said rod being electromechanically attached to said fuel metering valve to close said fuel iris means when said first fuel orifice is operable and to open said fuel iris means when said second fuel orifice is operable.

12. The improved hot gas engine of claim 11 further comprising transmission means operatively connected to said engine for translating engine power to work force.

13. The improved hot gas engine of claim 12 further comprising alternator means operatively connected to said engine for translating engine power to electrical energy.

14. The improved hot gas engine of claim 13 further comprising electrical energy storage means connected to the output of said alternator means for receiving and storing the electrical energy.

15. The improved hot gas engine of claim 14 further comprising electric motor means operably connected to said electrical energy storage means.

16. The improved hot gas engine of claim 15 further comprising switch means for controlling the operation of said alternator means.

* * * * *